US009395046B2

(12) United States Patent
Holder

(10) Patent No.: US 9,395,046 B2
(45) Date of Patent: Jul. 19, 2016

(54) LIQUID TO HIGH PRESSURE GAS TRANSFILL SYSTEM AND METHOD

(71) Applicant: KONINKLIJKE PHILIPS ELECTRONICS N.V., Endhoven (NL)

(72) Inventor: Gary Nathan Holder, Ringgold, GA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 505 days.

(21) Appl. No.: 13/872,573

(22) Filed: Apr. 29, 2013

(65) Prior Publication Data

US 2013/0233440 A1 Sep. 12, 2013

Related U.S. Application Data

(62) Division of application No. 12/739,165, filed as application No. PCT/IB2008/054339 on Oct. 21, 2008, now abandoned.

(60) Provisional application No. 60/981,648, filed on Oct. 22, 2007.

(51) Int. Cl.
*F17C 5/06* (2006.01)

(52) U.S. Cl.
CPC ..... *F17C 5/06* (2013.01); *F17C 2201/0109* (2013.01); *F17C 2201/056* (2013.01); *F17C 2201/058* (2013.01); *F17C 2203/0329* (2013.01); *F17C 2203/0391* (2013.01); *F17C 2205/0332* (2013.01); *F17C 2205/0335* (2013.01); *F17C 2221/011* (2013.01); *F17C 2221/014* (2013.01); *F17C 2221/017* (2013.01); *F17C 2221/03* (2013.01); *F17C 2223/0161* (2013.01); *F17C 2223/033* (2013.01); *F17C 2223/036* (2013.01); *F17C 2225/0123* (2013.01); *F17C 2225/0161* (2013.01); *F17C 2225/036* (2013.01); *F17C 2227/0311* (2013.01); *F17C 2227/0393* (2013.01); *F17C 2250/01* (2013.01); *F17C 2260/025* (2013.01); *F17C 2260/026* (2013.01);
(Continued)

(58) Field of Classification Search
CPC ..... F17C 2221/011; F17C 2270/025; F17C 2270/07; F17C 2270/0745; F17C 2250/043; F17C 2201/058; F17C 2270/02
USPC ..... 141/2, 18, 82, 95, 231, 197
See application file for complete search history.

(56) References Cited

U.S. PATENT DOCUMENTS

| | | | |
|---|---|---|---|
| 1,921,531 | A | 8/1933 | Levin |
| 2,028,119 | A | 1/1936 | Boshkoff |

(Continued)

FOREIGN PATENT DOCUMENTS

| | | |
|---|---|---|
| EP | 0933583 A2 | 8/1999 |
| GB | 216463 | 5/1924 |
| JP | 2004236858 | 8/2004 |

*Primary Examiner* — Mark A Laurenzi
*Assistant Examiner* — Timothy P Kelly
(74) *Attorney, Agent, or Firm* — Michael W. Haas

(57) ABSTRACT

The present invention describes methods and systems of oxygen transfill that includes the step of delivering a quantity of liquid oxygen to an evaporation chamber in a liquid oxygen evaporation device. Next, at least a portion of the liquid oxygen in the evaporation chamber is evaporated and a quantity of gaseous oxygen is maintained at a predetermined pressure level in the evaporation chamber. The method includes filling a portable compressed oxygen device with at least a portion of the gaseous oxygen.

18 Claims, 5 Drawing Sheets

(52) U.S. Cl.
CPC ..... *F17C 2270/025* (2013.01); *F17C 2270/07* (2013.01)

(56) References Cited

U.S. PATENT DOCUMENTS

| | | | | |
|---|---|---|---|---|
| 2,423,631 | A | 7/1947 | Akerman | |
| 3,001,375 | A | 9/1961 | Tauscher | |
| 5,558,139 | A * | 9/1996 | Snyder | A62B 7/02 141/95 |
| 5,853,062 | A | 12/1998 | Hulett | |
| 5,893,275 | A | 4/1999 | Henry | |
| 5,979,440 | A | 11/1999 | Honlonen | |
| 6,101,816 | A | 8/2000 | Wang | |
| 6,212,904 | B1 | 4/2001 | Arkharov | |
| 6,311,738 | B1 | 11/2001 | Mason | |
| 6,651,653 | B1 | 11/2003 | Honkonen | |
| 6,681,764 | B1 | 1/2004 | Honkonen | |
| 6,698,423 | B1 | 3/2004 | Honkonen | |
| 6,742,517 | B1 | 6/2004 | Frye | |
| 6,889,726 | B2 | 5/2005 | Richey, II | |
| 6,910,510 | B2 | 6/2005 | Gale | |
| 7,490,605 | B2 | 2/2009 | Frye | |
| 7,568,507 | B2 | 8/2009 | Farese | |
| 2011/0056217 | A1 * | 3/2011 | Fennessy | F17C 5/06 62/50.2 |

* cited by examiner

LIQUID TO HIGH PRESSURE GAS TRANSFILL SYSTEM AND METHOD

CROSS-REFERENCE TO RELATED APPLICATIONS

This application is a Divisional under 35 U.S.C. §120 of U.S. patent application Ser. No. 12/739,165, filed Oct. 21, 2008, which claims priority under 35 U.S.C. §119(e) from provisional U.S. patent application No. 60/981,648, filed Oct. 22, 2007, the contents of each of which are incorporated herein by reference.

BACKGROUND OF THE INVENTION

1. Field of the Invention

This invention relates generally to the field of oxygen generation, storage, and delivery, and, in particular, to systems and methods to efficiently and effectively transfill oxygen into portable oxygen delivery devices.

2. Description of the Related Art

More and more people are using oxygen therapy outside the hospital, permitting them to lead active, productive lives. People with asthma, emphysema, chronic bronchitis, occupational lung disease, lung cancer, cystic fibrosis, congestive heart failure, or other respiratory disorders may use oxygen therapy at home and use portable oxygen therapy devices outside of the home. Recent developments in oxygen therapy technology have given those dependent upon oxygen a variety of in-home and portable options for oxygen therapy. There are three main ways to personally administer oxygen therapy outside of a medical facility, (1) oxygen concentrators, (2) liquid oxygen devices, and (3) compressed gas devices. Each of these three types of solutions provide particular benefits and detriments.

First, oxygen concentrators, typically in the form of a pressure swing adsorption systems, are an excellent source of oxygen therapy for in home use. Pressure swing adsorption ("PSA") systems are advantageous in that they can process ambient air, containing approximately 21% oxygen, and separate that oxygen from the ambient air. Thereby, the user can be supplied with higher concentrations of oxygen. While suitable for their intended purpose, oxygen concentrators are generally bulky and require access to a power source, such as an electrical outlet. Thus, oxygen concentrators are ill-suited for portability and are not intended for use with an ambulatory individual.

Second, a liquid oxygen ("LOX") system can provide a convenient method of portable oxygen therapy. Liquid oxygen is advantageous because it occupies significantly less space than compressed gaseous oxygen. A conventional LOX system includes a large stationary LOX storage canister that stays in the home. The conventional system also includes a small, portable delivery apparatus that can be filled from the stationary unit for trips outside the home. Many first generation prior art systems have limited utilization due to the low LOX capacity of the portable delivery apparatus and the administered LOX flow rate. To maintain a liquid state, oxygen must be kept at a relatively cool temperature, e.g., around 300 degrees Fahrenheit below zero (−300° F.). Therefore, the liquid oxygen stored in LOX systems will evaporate, even if not used by the user. In this manner, the LOX system has a relatively short use period that expires regardless of whether the user is actually using the oxygen.

Third, compressed oxygen systems are generally prescribed for a variety of different types of oxygen therapy patients, including those that are relatively mobile and/or those for whom oxygen is not needed all the time, such as only when walking or performing physical activity. Small tanks containing compressed oxygen are well suited for portability in that they can be relatively light weight and they can maintain their supply of oxygen when not in use. Small portable compressed oxygen devices are limited, however, in how long they will last depending on the prescribed flow rate, the size (volume) of the tank and the pressure rating of the tank. Therefore, portable compressed oxygen devices must be refilled often.

Many prior art systems attempt to address the drawbacks presented by particular home oxygen therapy devices. For example, some oxygen concentrators have been designed to enable a user to fill portable compressed oxygen canisters from the oxygen concentrator. U.S. Pat. No. 5,853,062 ("the '062 patent") describes a pressure swing adsorption system that is capable of providing oxygen enriched air a first pressure and a second pressure. As shown in FIG. 1 of the '062 patent, the PSA is enabled to receive ambient air and output oxygen enriched air at a first low pressure outlet 106 for use by a user. Typically, a user would connect a nasal cannula to first low pressure outlet 106 in a manner similar to the majority of PSA systems. Further the PSA system of the '062 patent provides a second output from the concentrator 104 to a pressure intensifier 109. Pressure intensifier 109 has a drive air cylinder and a first and second stage product gas cylinder. The drive air cylinder of pressure intensified 109 can be operated to compress the gaseous oxygen of concentrator 104 and connect to a high pressure outlet 112. Thereby, the user can connect and re-charge a cylinder with compressed gas.

U.S. Pat. No. 6,446,630 ("the '630 patent") describes a PSA system configured to simultaneously provide oxygen therapy to a user and fill a portable oxygen cylinder. As shown in FIG. 1 of the '630 patent, the system provides an oxygen concentrator 11 connected to a flow position control valve 14 in communication with an inhalation sensor 21. When inhalation sensor 21 detects that the user is inhaling, the concentrator provides oxygen to the user. When the user is not inhaling, flow position control valve 14 connects the output of oxygen concentrator 11 to a compressor 17. Compressor 17 operates to compress the gas produced by oxygen concentrator 11 that is not used by the user. Once a sufficient quantity of gas is compressed, a portable gas cylinder 18 can be filled for use by the user.

U.S. Pat. No. 6,889,726 ("the '726 patent") describes a device for filling portable high pressure cylinders with a compressor and an oxygen concentrator. As shown in FIG. 2 of the '726 patent, the system provides an oxygen concentrator 12 having a standard configuration of sieve beds 24 connected to a product tank 22 and flow rate restrictors 28. Thereby, oxygen concentrator 12 is operative to provide oxygen-enriched gas to a user device 14, such as a nasal cannula. Additionally, when the output of the concentrator 12 is greater than needed to supply user device 14, the excess enriched gas from the user device 14 is directed to compressor 60.

As shown in FIG. 1 of the '726 patent, compressor 60 compresses the oxygen-enriched gas flowing into it and outputs the gas to a coupling 70. When a portable tank is connected to coupling 70, the relatively high pressure gaseous oxygen output from compressor 60 flows through coupling 70 and into a portable tank 20. As disclosed in the '726 patent, filing portable tank 20 from compressor 60 takes about 1 to 12 hours. The '726 patent also discloses a reservoir 90 connected to compressor 60. Compressor 60 is enabled to fill reservoir 90 when a portable tank 20 is not connected to coupling 70. Once reservoir 90 has been filled, a portable tank 20 can be connected to coupling 70 and filled in a shorter time span than filling direct from compressor 60. As disclosed in the '726 patent, the initial fill time for reservoir 90 can be as much as a week.

While suitable for their intended purposes, conventional oxygen transfill systems suffer from many drawbacks. The most significant drawback is that these systems require a compressor. The use of a compressor presents many drawbacks for the user. Significantly, compressors require significant amounts of power to operate. For example, the compressor of the system disclosed in '726 patent must run constantly for an entire week to fill the reservoir of the system. Such extensive usage requires a tremendous amount of electrical power and can be costly to the user. Furthermore, compressors are often bulky and generate significant noise in operation and during power cycles. For example, the compressor for a prior art gaseous oxygen transfill system may routinely turn on and off dependent upon the user's oxygen demands, as the compressor only receives oxygen when there is an excess supply.

An additional drawback for the user of a compressor based gaseous oxygen transfill system is that compressor often requires periodic maintenance and repair. As relatively high demands are placed on the compressor for a prior gaseous oxygen transfill system, such as continually generating pressures in excess of 2000 psi, these compressors often fail. When the compressor fails, the entire gaseous oxygen transfill system becomes inoperable as the pressure of the gaseous oxygen coming from the concentrator is far below that required for a portable compressed oxygen device.

A further drawback of prior art gaseous oxygen transfill systems relates to the time period necessary to fill a portable gas container. For example, the gaseous oxygen transfill system of the '726 patent requires up to 12 hours to fill a portable tank from the compressor. As the pressure of the oxygen output from the concentrator is relatively low, a great deal of time is required to pressurize the gas to a level sufficient for portability.

On a commercial scale, portable compressed oxygen devices are most often filled with gaseous oxygen in an industrial process using a system of industrial scale devices. For example, commercial oxygen providers typically have a transfill system that involves the use of large capacity liquid oxygen dewars and pneumatic compressors. Conventional large capacity liquid oxygen dewars are typically bulky and extremely heavy devices that are stored in a commercial oxygen provider's warehouse. These conventional large capacity liquid oxygen dewars typically produce gaseous oxygen at relatively low pressures, around 100 to 300 pounds-force per square inch gauge ("psig"). The commercial oxygen provider typically retrieves gaseous oxygen from the large capacity liquid oxygen dewars and outputs it to a large scale pneumatic compressor enabled to pressurize the gaseous oxygen to a pressure sufficient for storage in a portable compressed oxygen device. Conventional large scale pneumatic compressors are typically very voluminous and loud devices that run on electrical power or even diesel engines.

After the pneumatic compressor has pressurized the gaseous oxygen, portable compressed oxygen devices can be filled with the pressurized gas. This method has many drawbacks and limitations. One of the most significant is that this industrial process is completely unavailable to the user of the oxygen therapy devices. Moreover, this industrial process must be performed by a skilled technician in an industrial environment with great precision to reduce the risk of injury. Furthermore, this process requires the commercial oxygen provider to retrieve portable compressed oxygen devices from the user's homes, take them back to the site of industrial system to be refilled, and then return the portable compressed oxygen devices to the homes of the users. This is costly, inefficient, and cumbersome for both the commercial oxygen provider and the user.

U.S. Pat. No. 1,921,531 ("the '531 patent") describes a system for filing pressure cylinders (reference numeral 2) with gas from a vaporizer (reference numeral 1). Although the '531 patent does not implement a compressor to provide gas from the vaporizer to the cylinders, the '531 patent also does not regulate pressure anywhere within the system. For example, the '531 patent does not provide any mechanisms for preventing over-pressure in the system. As another example, the '531 patent does not regulate the dispensing of gas from the vaporizer to the cylinders based on pressure within the vaporizer. As yet another example, the '531 patent does not control evaporation within the vaporizer to regulate pressure and/or the dispensing of gas in the system.

SUMMARY OF THE INVENTION

The present invention describes methods and systems of oxygen transfill. An exemplary embodiment of the present invention provides a method of oxygen (gas) transfill that includes the step of delivering a quantity of liquid oxygen (gas) to an evaporation chamber in a liquid oxygen evaporation device. Next, the method includes the steps of evaporating a portion of the quantity of liquid oxygen in the evaporation chamber and maintaining a quantity of gaseous oxygen at a predetermined pressure level in the evaporation chamber. Finally, the method includes the step of filling a portable compressed oxygen device with the quantity of gaseous oxygen at the predetermined pressure level.

A further exemplary embodiment of the present invention provides a high pressure oxygen (gas) transfill system that includes a liquid oxygen (gas) evaporation device having an evaporation chamber enabled to receive a quantity of liquid oxygen and evaporate a portion of the quantity of liquid oxygen into a quantity of gaseous oxygen. The evaporation chamber can maintain the quantity of gaseous oxygen at a predetermined pressure level sufficient for storage in a portable compressed oxygen device.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION OF THE EXEMPLARY EMBODIMENTS

Figure 1:
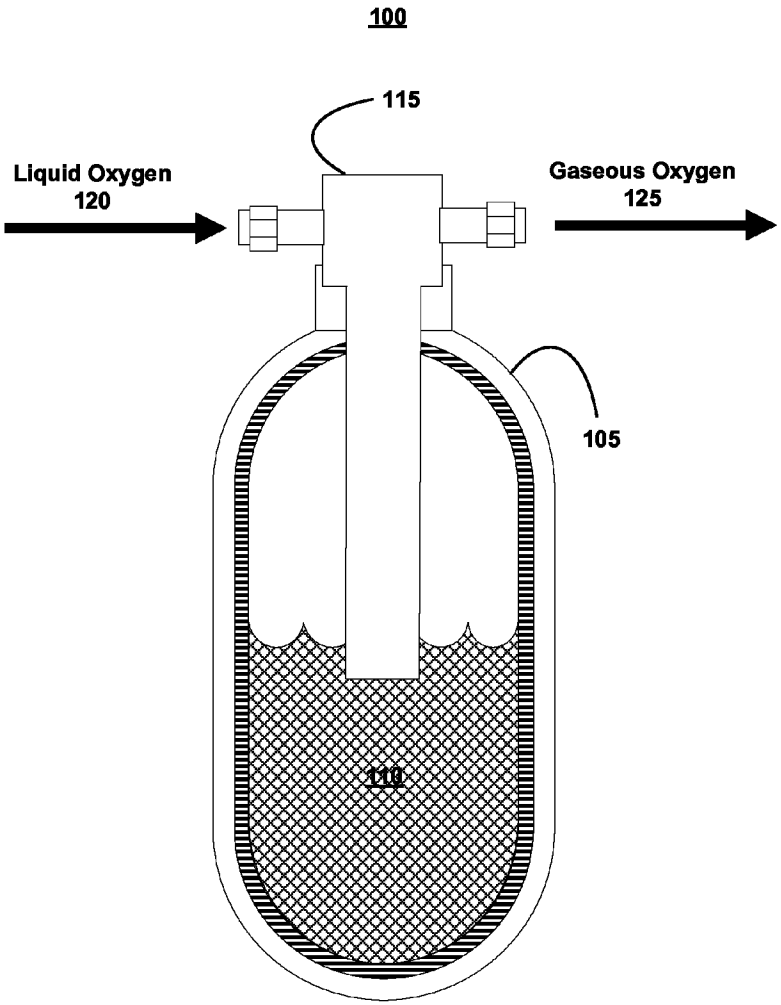
FIG. 1 provides an illustration of an oxygen transfill system in accordance with an exemplary embodiment of the present invention.

The present invention addresses the drawbacks of conventional oxygen transfill systems. Significantly, the present invention provides methods and apparatus for oxygen transfill that efficiently delivers gaseous oxygen to a portable compressed oxygen device. Therefore, an oxygen transfill system provided in accordance with the present invention is enabled to safely and quickly fill a portable container. The present invention provides methods and systems that safely enable users to perform oxygen transfill in the home, as opposed to the conventional controlled industrial processes.

It should be noted that while oxygen is described herein as the gas being used in the transfill process of the present invention, other gasses or gas mixtures are equally suited for use in the apparatus and method of the present invention, such as nitrogen, helium, helium-oxygen (heliox), etc.

In an exemplary embodiment, the present invention provides a method of oxygen transfill that includes the step of delivering a quantity of liquid oxygen to an evaporation chamber in a liquid oxygen evaporation device. Next, the method includes the steps of evaporating a portion of the quantity of liquid oxygen in the evaporation chamber and maintaining a quantity of gaseous oxygen at a predetermined pressure level in the evaporation chamber. Finally, the method includes the step of filling a portable compressed oxygen device with the quantity of gaseous oxygen at the predetermined pressure level.

In addition to methods of oxygen transfill, the present invention provides an oxygen transfill system that includes a liquid oxygen evaporation device having an evaporation chamber enabled to receive a quantity of liquid oxygen and evaporate a portion of the quantity of liquid oxygen into a quantity of gaseous oxygen. The evaporation chamber can maintain the quantity of gaseous oxygen at a predetermined pressure level sufficient for storage in a portable compressed oxygen device.

The systems and methods of oxygen transfill in accordance with the present invention permit users to safely perform gaseous oxygen transfill from a liquid oxygen source in the home. Previously, users were unable to perform oxygen transfill from oxygen in a cryogenic liquid state in the home. The primary method of filling portable oxygen containers with prior art devices required the costly and time consuming use of a compressor. Relying on a compressor to take gaseous oxygen from a low pressure state to high pressure state requires a significant amount of time and electric power, adding to the user's cost. For the majority of conventional systems, a user would have to plan in advance as to when portable gaseous oxygen containers would be needed, such that a compressor could be driven for a sufficient time period, sometimes hours, to fill those containers. The systems and methods of the present invention overcome these drawbacks of the prior art, and permit the user to quickly fill a portable oxygen container for use. Much like making a pot of coffee, a user is enabled by the systems and methods of the present invention to quickly fill a portable compressed oxygen device and be on their way.

FIG. 1 provides an illustration of an oxygen transfill system 100 in accordance with an exemplary embodiment of the present invention. FIG. 1 depicts a basic configuration for a liquid oxygen evaporation device 105 according to an exemplary embodiment of oxygen transfill system 100. As shown in FIG. 1, liquid oxygen evaporation device 105 includes an evaporation chamber 110. Furthermore, liquid oxygen evaporation device 105 is enabled to receive liquid oxygen 120 through a port 115. Port 115 is in communication with evaporation chamber 110. Therefore, liquid oxygen 120 can be delivered into evaporation chamber 110. Once in evaporation chamber 110, liquid oxygen 120 is permitted to boil or evaporate to create a quantity of gaseous oxygen 125. This quantity of gaseous oxygen 125 is maintained in the vacant portion, or headspace, of evaporation chamber 110. Significantly, evaporation chamber 110 of liquid oxygen evaporation device 105 is enabled to maintain this gaseous oxygen 125 at relatively high pressures.

In an exemplary embodiment, evaporation chamber 110 is enabled to maintain gaseous oxygen at pressures ranging from 100 psig to 5,000 psig. For example, and without limitation, evaporation chamber 110 may consistently maintain gaseous oxygen around 2000 psig. In an alternative embodiment, evaporation chamber 110 is configured and arranged to maintain oxygen at pressures at or around 4000 psig. Those of skill in the art will appreciate that different implementations of the oxygen transfill system have different requirements; thus, evaporation chamber 110 can be configured to accommodate different pressure ranges.

In an exemplary embodiment, liquid oxygen 120 in evaporation chamber 110 is permitted to boil until a certain predetermined pressure of gaseous oxygen 125 is reached inside the evaporation chamber. Once the predetermined pressure is reached, the user is enabled to output gaseous oxygen 125 through port 115 to fill a portable compressed oxygen device.

Oxygen transfill system 100 of the present invention presents many significant advancements over conventional transfill systems because no other devices provide a liquid to gas oxygen transfill. Unlike many of the oxygen transfill systems of the prior art, oxygen transfill system 100 of the present invention does not require a compressor. For example, the breathable gaseous oxygen of prior art systems is typically supplied at a relatively low pressure levels, and thus a compressor must be used to compress the gas to pressure level sufficient for storage in a portable tank. In an exemplary embodiment of oxygen transfill system 100, no compressor is required, as gaseous oxygen 125 is output from port 115 at a pressure level sufficient for storage in a portable compressed oxygen device. Herein, the phrase "pressure level sufficient for storage in a portable compressed oxygen device" is used to mean a pressure that will enable storage in a container sufficient for portable use.

Those of skill in the art will appreciate that a "pressure level sufficient for storage in a portable compressed oxygen device" may vary according to implementation. For example, and not limitation, common portable compressed oxygen storage devices can store oxygen at pressures between 500 psig and 2000 psig. Alternatively, other portable compressed oxygen devices can store oxygen at higher pressures between 1500 psig and 4000 psig.

Liquid oxygen evaporation device 105 of oxygen transfill system 100 relies upon the inherent qualities of liquid oxygen 120 to create gaseous oxygen 125 at a pressure level sufficient for storage in a portable compressed oxygen device. More particularly, the boiling point of liquid oxygen is 90.188 K (−182.96° C.) at 101.325 kPa (760 mm Hg); thus, liquid oxygen readily boils in a system exposed to the ambient environment. Therefore, when liquid oxygen is inserted into evaporation chamber 110, it will naturally boil to create gaseous oxygen 125.

Those of skill in the art will appreciate that oxygen transfill system 100 in FIG. 1 is an exemplary embodiment, and the oxygen transfill system could be configured in a variety of different ways without detracting from the scope of the invention. For example, and without limitation, evaporation chamber 110 could be configured with a very small headspace, or room for a quantity of gaseous oxygen, and the gaseous oxygen could be output to another chamber for storage. Thus, the boiloff vessel need not be used for storing the gas generated from the evaporation process. A check valve can be provided between the boiloff vessel and the high pressure gas storage vessel. The present invention also contemplates that the gas left over in the boiloff vessel, e.g., after filling the portable storage vessel can be stored in the boiloff vessel or it can be used for other uses. One such is to provide the gas back to the liquefaction device. That is, the left over gas could be bled back into the liquefaction system to be reliquefied.

Figure 2:
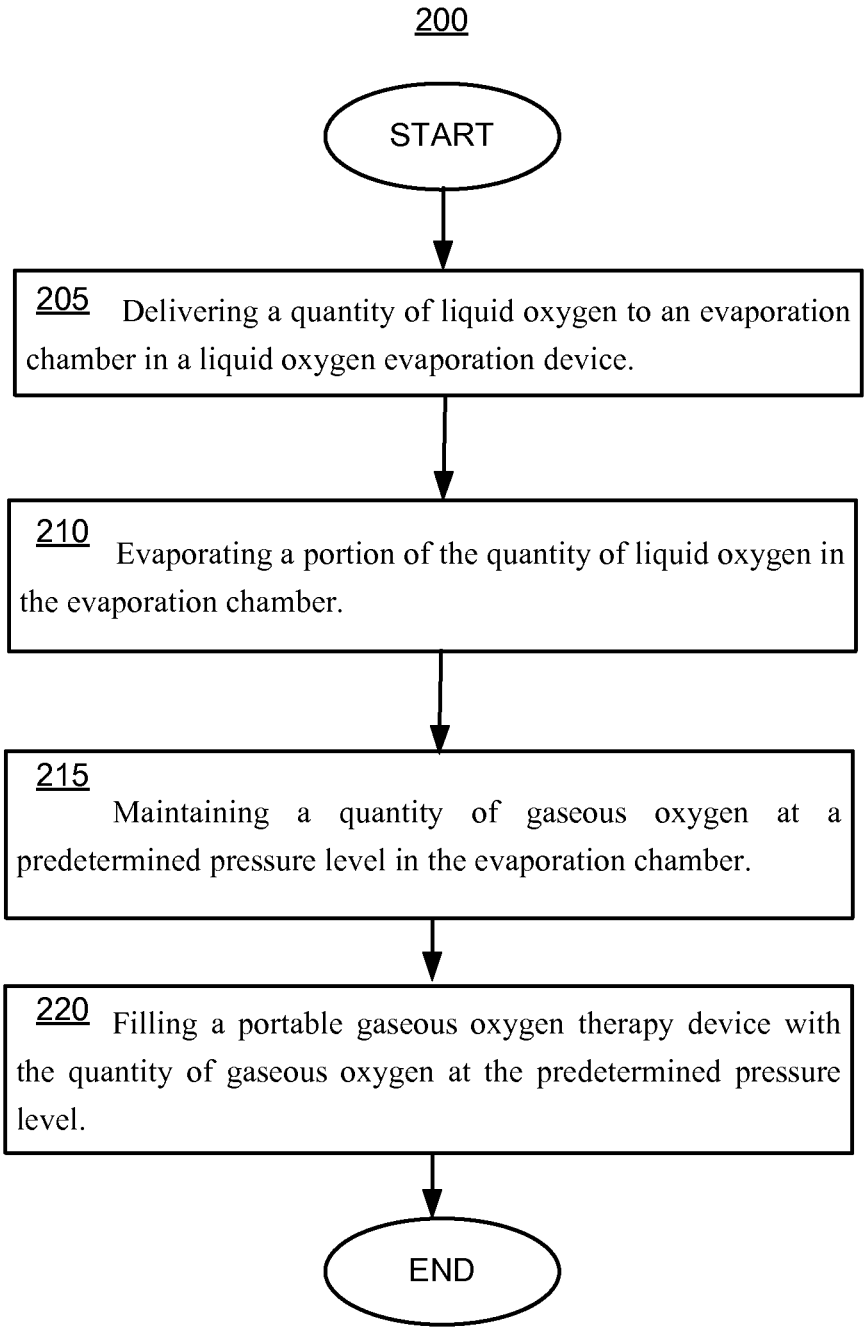
FIG. 2 provides an illustration of a method of oxygen transfill in accordance with an exemplary embodiment of the present invention.

FIG. 2 provides an illustration of a method of oxygen transfill 200 in accordance with an exemplary embodiment of the present invention. The method of oxygen transfill 200 shown in FIG. 2 illustrates the convenient and efficient process by which a user may transfill oxygen to a portable compressed oxygen device. First, step 205 involves delivering a quantity of liquid oxygen to an evaporation chamber in a liquid oxygen evaporation device. In an exemplary embodiment, the quantity of liquid oxygen can be delivered from a stationary LOX source dewar. Those of skill in the art will appreciate that the liquid oxygen evaporation device can be filled by a variety of sources, including a LOX generating device, i.e., a device that produces liquid oxygen or other gas from air. U.S. Pat. Nos. 5,893,275; 6,212,904; 5,979,440; 6,651,653; 6,681,764; and 6,698,423 the contents of each of which are incorporated herein by reference, teach portable systems for generating a supply of liquid oxygen.

Next, step 210 involves evaporating a portion of the quantity of liquid oxygen in the evaporation chamber. Therefore, once the liquid oxygen has entered the evaporation chamber, the liquid is either caused to or permitted to boil and create a quantity of gaseous oxygen in the vacant area of the evaporation chamber. The present invention contemplates providing a component or components to assist or facilitate the evaporation (boiloff) process. For example, one or more heating elements can be provided in combination with the evaporation chamber to control the temperature of the fluid in the evaporation chamber.

The evaporation of a portion of the quantity of liquid oxygen creates a quantity of gaseous oxygen in the evaporation chamber and increases the pressure level in the evaporation chamber. In step 215, this quantity of gaseous oxygen is maintained at a predetermined pressure level. It can be appreciated that pressure regulating devices, such as a pressure relief valve, heater, or other device, can be used to regulate the pressure of the gaseous oxygen in the evaporation chamber.

Finally, step 220 involves filling a portable compressed oxygen device with the quantity of gaseous oxygen at the predetermined pressure level. Therefore, in an exemplary embodiment, once the pressure of the gaseous oxygen in the evaporation chamber reaches a predetermined pressure level, it can be output into a portable compressed oxygen device. Of course, the gaseous oxygen in the evaporation chamber can be delivered from the evaporation chamber to the portable compressed oxygen device even if the pressure of the gaseous oxygen in the evaporation chamber has not reached the predetermined pressure level, but doing do, may not result in complete filling of the portable compressed oxygen device.

The method of oxygen transfill system 200 illustrated in FIG. 2 provides a user with a rapid method by which to fill gas storage canisters for portable use. Using conventional gas transfill systems may have taken the user a number of hours to fill portable gas canisters via a compressor. Using the exemplary embodiment of the method of oxygen transfill 200 shown FIG. 2, the user can decide to leave the home, quickly fill one or more portable high pressure gas canisters with the liquid oxygen evaporation device, and have one or more canisters ready to provide portable oxygen therapy.

Figure 3:
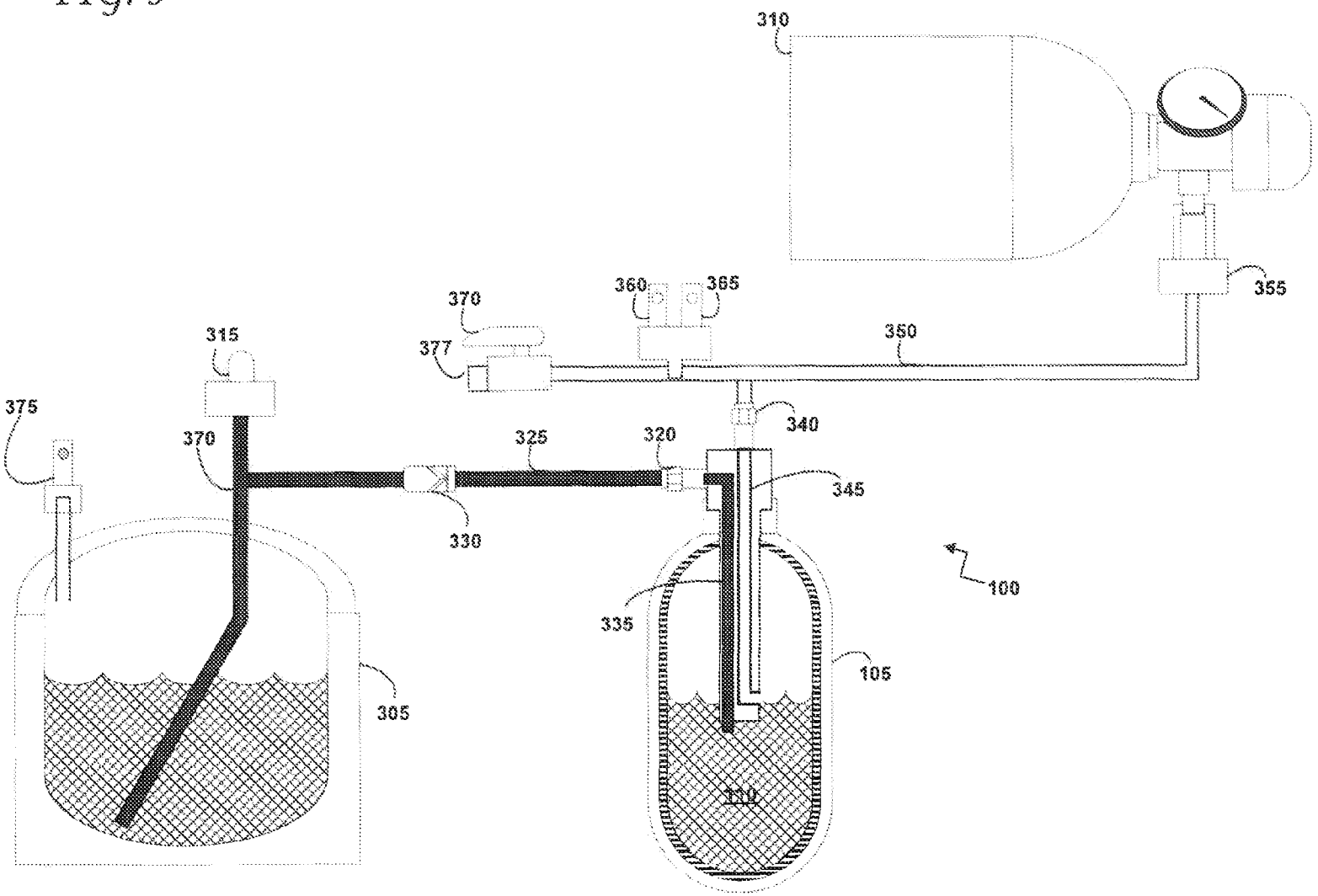
FIG. 3 provides an illustration of an oxygen transfill system, a LOX source dewar, and a portable compressed oxygen device, in accordance with an exemplary embodiment of the present invention.

FIG. 3 provides an illustration of an oxygen transfill system 100, a LOX source dewar 305, and a portable compressed oxygen (high pressure gas storage) device 310, in accordance with an exemplary embodiment of the present invention. As shown in the exemplary embodiment depicted in FIG. 3, oxygen transfill system 100 is configured to receive liquid from a LOX source dewar 305. LOX source dewar 305 can be a dewar with an evacuated region. The evacuated region of LOX source dewar 305 enables excellent insulation, and thus the contents of dewar 305 remain in liquid state with relatively minimal boiling for an extended period of time without the need for refrigeration equipment. Therefore, LOX source dewar 305 can hold a relatively large volume of liquid oxygen and serve to replenish oxygen transfill system 100 multiple times.

LOX source dewars, such as LOX source dewar 305, are often large, bulky and difficult to transport. Thus, LOX source dewars are often brought to the home by truck and transported by professionals. As shown in FIG. 3, LOX source dewar 305 can have a liquid source line 370. Liquid source line 370 enables liquid oxygen to be extracted from LOX source dewar 305. LOX source dewar 305 can be used to transfill liquid oxygen to a number of different devices. For example, and without limitation, liquid source line 370 can be connected to a portable LOX fill coupling 315, which can enable liquid oxygen to be transmitted to a portable LOX device. Additionally, in an exemplary embodiment, LOX source dewar 305 can include a relief valve 375 enabled to relieve excess pressure in LOX source dewar 305.

In an exemplary embodiment, liquid oxygen evaporation device 105 can be connected to liquid source line 370 of LOX source dewar 305 such that liquid oxygen can be delivered to the liquid oxygen evaporation device from dewar 305. As shown in FIG. 3, liquid oxygen evaporation device 105 includes an input port 320. Input port 320 can be connected via liquid transfill line 325 to liquid source line 370. In the exemplary embodiment, liquid transfill line 325 includes a check valve, such as cryogenic check valve 330. Cryogenic check valve 330 can be used to permit liquid oxygen to flow from LOX source dewar 305 to liquid oxygen evaporation device 105 and prevent gaseous oxygen from flowing along a reverse path back into the LOX source dewar.

Liquid oxygen evaporation device 105 also includes a liquid fill tube 335, through which liquid oxygen is delivered from input port 320 into the evaporation chamber 110. As shown in FIG. 3, evaporation chamber 110 can contain both liquid oxygen and gaseous oxygen in various proportions. For example, and without limitation, evaporation chamber 110 can be filled to a level equivalent to a height of end of liquid fill tube 335.

As shown in FIG. 3, liquid oxygen evaporation device 105, in an exemplary embodiment, can also include an output port 340. Output port 340, in an exemplary embodiment, can be used to export gaseous oxygen from liquid oxygen evaporation device 105. A gas use tube 345 connects output port 340 to the interior of evaporation chamber 110 in an exemplary embodiment. Thereby, gaseous oxygen contained in the evaporation chamber can be extracted from the liquid oxygen evaporation device.

Output port 340 can be configured, as illustrated in FIG. 3, such that a portable compressed oxygen device 310 can be filled by oxygen transfill system 100. In an exemplary embodiment, oxygen transfill system 100 provides a portable gas transfill line 350, which is connected to output port 340 of liquid oxygen evaporation device 105. Portable gas transfill line 350 includes a portable gas fill coupling 355, as shown in the exemplary embodiment depicted in FIG. 3. Portable gas fill coupling 355 enables convenient removable attachment of portable compressed oxygen devices, such as device 310. In an exemplary embodiment, portable compressed oxygen device 310 can be connected to portable gas fill coupling 355, and gaseous oxygen from the oxygen transfill system 100 can fill device 310.

Portable gas transfill line 350 can provide relief valve 360 and a redundant relief valve 365, in an exemplary embodiment, to ensure the safety of the system. Relief valve 360 can aid in preventing excess pressure build up in liquid oxygen evaporation device 105. In the event that pressure inside evaporation chamber 110 of liquid oxygen evaporation device 105 exceeds a predetermined limit, e.g., due to the evaporation of liquid oxygen in the evaporation chamber 110, relief valve 360 can open and vent gaseous oxygen to the atmosphere. Should relief valve 360 fail, redundant relief valve 365 ensures that pressure inside the liquid oxygen evaporation device 105 does not exceed a predetermined limit.

Portable gas transfill line 350 of oxygen transfill system 100 can also provide a high pressure valve 370 and vent 377. In an exemplary embodiment, the high pressure valve 370 and vent 377 are used to expel gaseous oxygen from the liquid oxygen evaporation device 105. For example, and without limitation, high pressure valve 370 can be opened to vent 377 all the gaseous oxygen in evaporation chamber 110 of liquid oxygen evaporation device 105 before refilling liquid oxygen evaporation device 105. Additionally, high pressure valve 370 and vent 377 can be used to control the pressure of the gaseous oxygen contained in the oxygen transfill system, such that a desired pressure level for oxygen transfill can be obtained before filling portable compressed oxygen device 310.

In accordance with an exemplary embodiment of the method of oxygen transfill 200 of the present invention, the user can be enabled to use the oxygen transfill system 100 depicted in FIG. 3 to safely, conveniently, and rapidly fill a portable compressed oxygen device 310. The first step of the method of oxygen transfill 200, using the exemplary embodiment of oxygen transfill system 100 shown in FIG. 3, involves filling evaporation chamber 110 with liquid oxygen from LOX source dewar 305 by connecting liquid transfill line 325 to liquid source line 370.

Once connected, liquid from LOX source dewar 305 can flow through cryogenic check valve 330 and into evaporation chamber 110. Next, the liquid oxygen in evaporation chamber 110 can be permitted to boil. The process of boiling can occur through the natural warming of liquid oxygen evaporation device 105 to the temperature of the ambient environment or can be induced with a heating apparatus in the liquid oxygen evaporation device 105.

Once the liquid in evaporation chamber 110 begins to boil, gaseous oxygen begins to build in the evaporation chamber. In accordance with an exemplary embodiment of the method of oxygen transfill, evaporation chamber 110 maintains the gaseous oxygen as it builds to a predetermined pressure level. Once this predetermined pressure level has been achieved, gaseous oxygen can be output from liquid oxygen evaporation device 105 to a portable compressed oxygen storage device 310 connected to portable gas fill coupling 355. The entire method can be quickly and safely performed by the user in the home. Moreover, the entire method of oxygen transfill can be performed in a relatively short time span, such as less than five minutes, and preferably less than two minutes.

Significantly, the method of using oxygen transfill 200 provided in accordance with an exemplary embodiment of the present invention does not require any external energy source or mechanical source. For conventional systems, however, a compressor must be driven by an external energy source to create portable gas. As shown in FIG. 3, all the components of oxygen transfill system 100 of an exemplary embodiment of the present invention are passive. The energy needed to create gaseous oxygen at portable pressure levels is inherent in the liquid oxygen inserted into liquid oxygen evaporation device 105. Thus, the energy necessary to carry out the oxygen transfill is actually inserted during the creation of the cryogenic liquid oxygen. In this manner, the natural process of the evaporation of the liquid oxygen at temperatures above the cryogenic boiling point is relied upon to create the pressurized gas instead of the conventional method of using a compressor.

Figure 4:
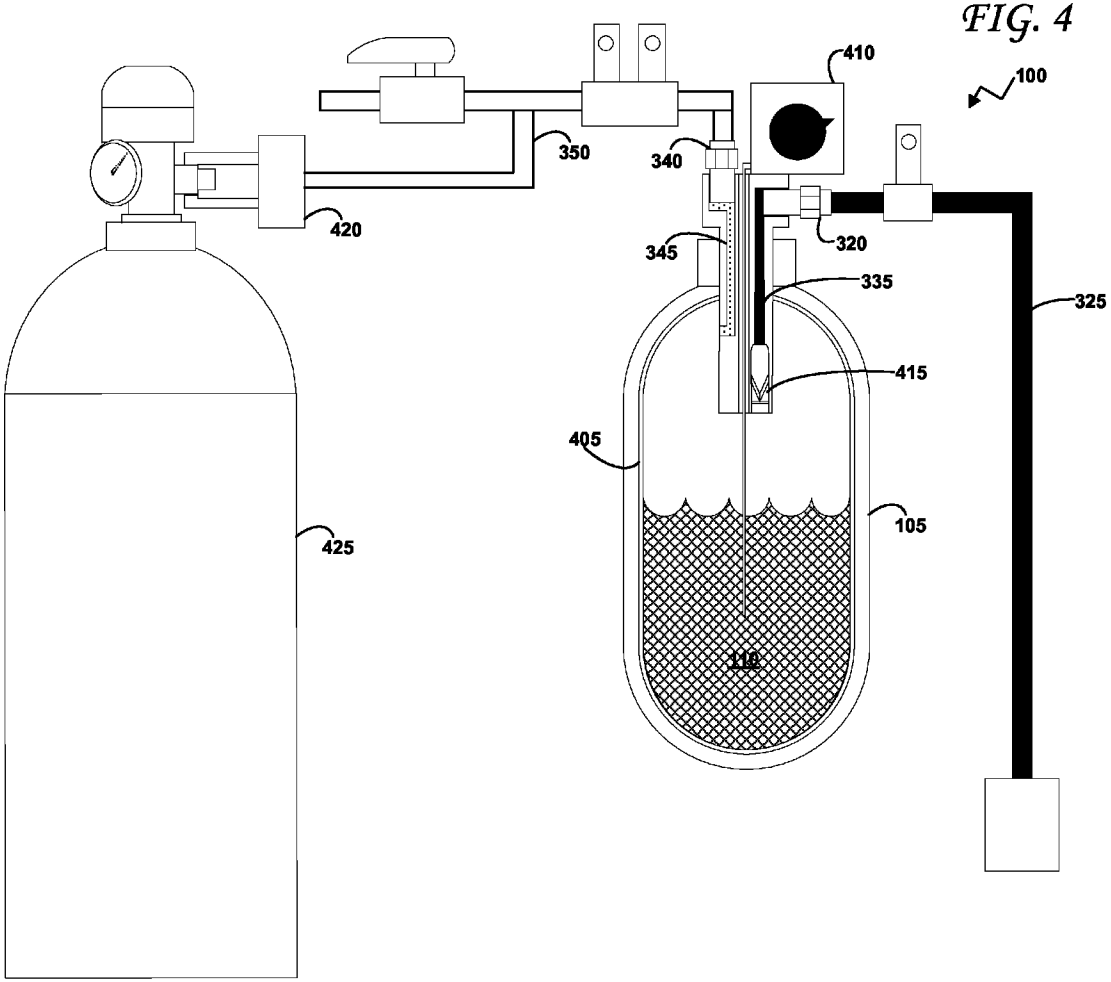
FIG. 4 provides an illustration of an oxygen transfill system in accordance with an alternative embodiment of the present invention.

FIG. 4 provides an illustration of an oxygen transfill system 100 in accordance with an alternative embodiment of the present invention. Those of skill in the art will appreciate that liquid oxygen evaporation device 105 of oxygen transfill system 100 can be configured in a variety of different ways without detracting from the scope of the invention. The alternative embodiment of liquid oxygen evaporation device 105 shown in FIG. 4 includes an insulation layer 405 to aid the insulation of evaporation chamber 110. The boiling point of liquid oxygen is significantly lower than ambient temperature; thus, evaporation chamber 110 must be insulated to reduce the rate of heat transfer between the evaporation chamber and ambient environment and prevent rapid evaporation of the liquid oxygen inserted into the evaporation chamber.

In the exemplary embodiment shown in FIG. 4, insulation layer 405 is provided as a lining to evaporation chamber 110. Insulation layer 405 layer can be one of many different types of materials capable of reducing the rate of heat transfer between evaporation chamber 110 and ambient environment or a combination of materials. For example, and without limitation, insulation layer 405 can be a foam or a fibrous material capable of reducing the rate of heat transfer. In an exemplary embodiment, insulation layer 405 is comprised of a synthetic fluoropolymer, such as polytetrafluoroethylene (PTFE), also known as Teflon®. As the purpose of evaporation chamber 110 is to boil liquid oxygen, it is not the object of insulation layer 405 to completely prevent heat transfer between the evaporation chamber and the ambient environment. Therefore, insulation layer 405 can be configured according to the parameters desired for a given implementation of liquid oxygen evaporation device 105 of oxygen transfill system 100. For example, and without limitation, if a particular embodiment of liquid oxygen evaporation device 105 is configured to boil liquid at a relatively rapid rate, then insulation layer 405 can be configured to provide a smaller amount of deterrence to the rate of heat transfer.

In an alternative embodiment, such as the one shown in FIG. 4, liquid oxygen evaporation device 105 of oxygen transfill system 100 is provided with a heating device 410 to aid in raising/controlling the temperature of the liquid oxygen when desired. For the alternative embodiment of the liquid oxygen evaporation device 105 having a heating device 410, insulation layer 405 can be configured with a larger amount of deterrence to the rate of heat transfer, as the ambient environment is not the only factor in raising the temperature of the liquid oxygen in the evaporation chamber 110. Thus, evaporation chamber 110 can hold a quantity of liquid oxygen for a longer period before all of the liquid boils. For the embodiment depicted in FIG. 4, heating device 410 can be employed when it is desired to advance the boiling rate of the liquid oxygen in evaporation chamber 110. The present invention also contemplates providing a cooling system (not shown) associated with evaporation chamber 110 to control the temperature, and hence, the pressure of the gas and/or liquid contained in evaporation chamber 110.

As shown in the exemplary embodiment depicted in FIG. 4, oxygen transfill system 100 can include a liquid transfill line 325 enabled to receive liquid oxygen from a source container. In an exemplary embodiment, liquid transfill line 325 is connected to an input port 320 on liquid oxygen evaporation device 105. Furthermore, input port 320 is connected to a liquid fill tube 335 in communication with the evaporation chamber 110. Thereby, liquid oxygen evaporation device 105 can be connected to a liquid oxygen source container and liquid can be inserted through liquid fill tube 335 into evaporation chamber 110. Liquid fill tube 335 can be provided with a check valve 415 to permit the insertion of liquid oxygen through liquid fill tube 335, but prevent gaseous oxygen contained in evaporation chamber 110 from exiting the chamber through liquid fill tube 335.

The exemplary embodiment of liquid oxygen evaporation device 105 shown in FIG. 4 provides a gas use tube 345, through which gaseous oxygen can be output from evaporation chamber 110. Gas use tube 345 can be connected to output port 340, which is further connected to gas transfill line 350. Gas transfill line 350 can provide a gas fill coupling 420, to which a variety of different gaseous oxygen containers can be connected. In this manner, oxygen transfill system 100 can be used to fill large and small portable oxygen therapy devices and also large gas storage containers.

Users desire different portable compressed oxygen devices for different purposes and applications. The table below provides the various standards in the industry for portable compressed oxygen devices:

TABLE 1

Conventional Specifications for Portable Compressed Oxygen Devices

| Name | Diameter (in.) | Height (in.) | Capacity (liters) | Weight (lb.) |
|---|---|---|---|---|
| M-2 | 3.21 | 5.37 | 34 | 0.7 |
| A or M-4 | 3.21 | 8.4 | 113 | 1.6 |
| B or M-6 | 3.21 | 11.6 | 164 | 2.2 |
| ML-6 | 4.38 | 7.68 | 165 | 2.8 |
| M-7 | 4.38 | 9.18 | 198 | 3.3 |
| C or M-9 | 4.38 | 10.7 | 255 | 3.7 |
| D or M-15 | 4.38 | 16.5 | 425 | 5.3 |
| E or M-24 | 4.38 | 24.9 | 680 | 7.9 |

The various embodiments of oxygen transfill system 100, in accordance with the present invention, can be used to fill all of the different types of portable compressed oxygen devices listed in Table 1 and many others. Different portable compressed oxygen devices provide different benefits for the user; thus, oxygen transfill system 100 can be configured to fill the type of portable oxygen therapy device that best fits the user's needs.

In the exemplary embodiment shown in FIG. 4, oxygen transfill system 100 is used to fill gas storage container 425, a relatively large gaseous oxygen container. The capacity of gas storage container 425 is larger than the portable compressed oxygen device 310 shown in FIG. 3. For example, and without limitation, gas storage container 425 can be an E cylinder capable of holding 680 liters of gaseous oxygen. Certain portable oxygen therapy devices may require the multiple iterations of the method of oxygen transfill 200 in accordance with the present invention to the gas storage container 425. In other words, oxygen transfill system 100 may only be able to generate a portion of the total capacity of a portable oxygen therapy device with one cycle of liquid to oxygen transfill. Thus, to fill the total capacity may require refilling the evaporation chamber, boiling off the liquid to gas, and transferring the high pressure gas to the gas storage container. This process can be repeated as necessary.

In addition to the ability to be configured to generate different volumes of gaseous oxygen, various embodiments of oxygen transfill system 100 can be configured to generate gaseous oxygen at multiple pressure levels. In a non-limiting example, it may be desired to configure oxygen transfill system 100 to generate gaseous oxygen at 2000 psig for certain portable oxygen therapy devices and 3000 psig for other portable oxygen therapy devices. For various embodiments of oxygen transfill system 100, the amount of oxygen input into evaporation chamber 110 of a predetermined volume dictates the pressure level of gaseous oxygen that can be created by the oxygen transfill system.

Liquid oxygen has an expansion ratio of 860:1. Thus, in general terms, one liter of oxygen in a liquid form is equivalent to 860 liters of oxygen in a gaseous form. It is this expansion ratio that enables the generation of a compressed gas within evaporation chamber 110. Based on this expansion ratio, the amount of liquid oxygen required by the liquid oxygen evaporation device 105 of oxygen transfill system 100 to create a desired amount of gaseous oxygen at a desired pressure level can be calculated. Specifically, the amount of liquid oxygen necessary to create a desired gaseous oxygen pressure level in a given volume can be calculated using Van Der Waals equation below:

$$\left(P + a\frac{n^2}{V^2}\right)(V - nb) = nRT$$

where,

P=Pressure in bar,

V=Volume in Liters, n=Quantity of gas in moles,

R=The universal gas constant 0.0831451 if using bar and liters,

T=The temperature in Kelvin, a=Van Der Waal's Constant for real Oxygen gas 1.382 bar $L^2/mol^2$, and b=Van Der Waal's Constant for real Oxygen gas 0.03186 L/mol By solving Van Der Waals equation for the quantity of gas in moles (n), the number of moles of liquid oxygen needed, when expanded to a gas, to create a desired pressure within a given volume of evaporation chamber 110 can be determined. Solving Van Der Waals equation above for n results in the third order equation below.

$$-a\frac{b}{V^2}n^3 + \frac{a}{V}n^2 - (bP + RT)n + PV = 0$$

By inserting the given volume (V) of evaporation chamber 110 and the desired pressure (P), the equation above can be solved for n. Multiplying n by the molecular weight of oxygen (31.9988) gives the amount of liquid oxygen necessary for the desired oxygen transfill. Table 2 below provides a description of the amount of liquid oxygen needed to fill common portable oxygen therapy devices in accordance with calculations using the above equation.

TABLE 2

| Cylinder Size | Service Pressure bar | Diameter mm | Length mm | Empty Weight kgs | Liquid Volume liters | LOX required to achieve Service Pressure at room temperature kgs | Usable Gaseous Oxygen Volume liters |
|---|---|---|---|---|---|---|---|
| M4 | 153 | 81.5 | 213 | .7 | .7 | 0.140 | 113 |
| M6 | 153 | 81.5 | 294 | 1.0 | 1.0 | 0.199 | 170 |
| M9 | 139 | 111.3 | 272 | 1.6 | 1.7 | 0.339 | 255 |
| ME | 139 | 111.3 | 632 | 3.4 | 4.6 | 0.917 | 680 |

Liquid oxygen evaporation device 105 can be provided with a variety of different devices to enable the user to easily insert the proper amount of liquid oxygen for a particular evaporation chamber 110, as calculated with the equation above. In the exemplary embodiment shown in FIG. 4, liquid oxygen evaporation device 105 provides a liquid fill tube 335 that penetrates to a predetermined depth within the evaporation chamber 110. Thereby, the user is enabled to insert liquid oxygen into the evaporation chamber 110 until a spitting sound is made, indicated to the user that the level of liquid oxygen in evaporation chamber 110 has reached a level equivalent to the depth of the liquid fill tube 335 and the insertion of liquid oxygen can cease. In this manner, liquid fill tube 335 can be set at a depth that provides the necessary volume for liquid gas below the liquid fill tube.

In an alternative embodiment, liquid oxygen evaporation device 105 includes sensors that are configured to indicate to the user filling the evaporation chamber 110 that the proper of amount of liquid oxygen has been added. For example, a flow sensor associated with liquid transfill line 325 can monitor the amount of liquid delivered to the evaporation chamber. In a more advanced embodiment, the system can automatically discontinue the transfer of liquid to the evaporation chamber when the desired amount of liquid as been provided to the evaporation chamber.

Figure 5:
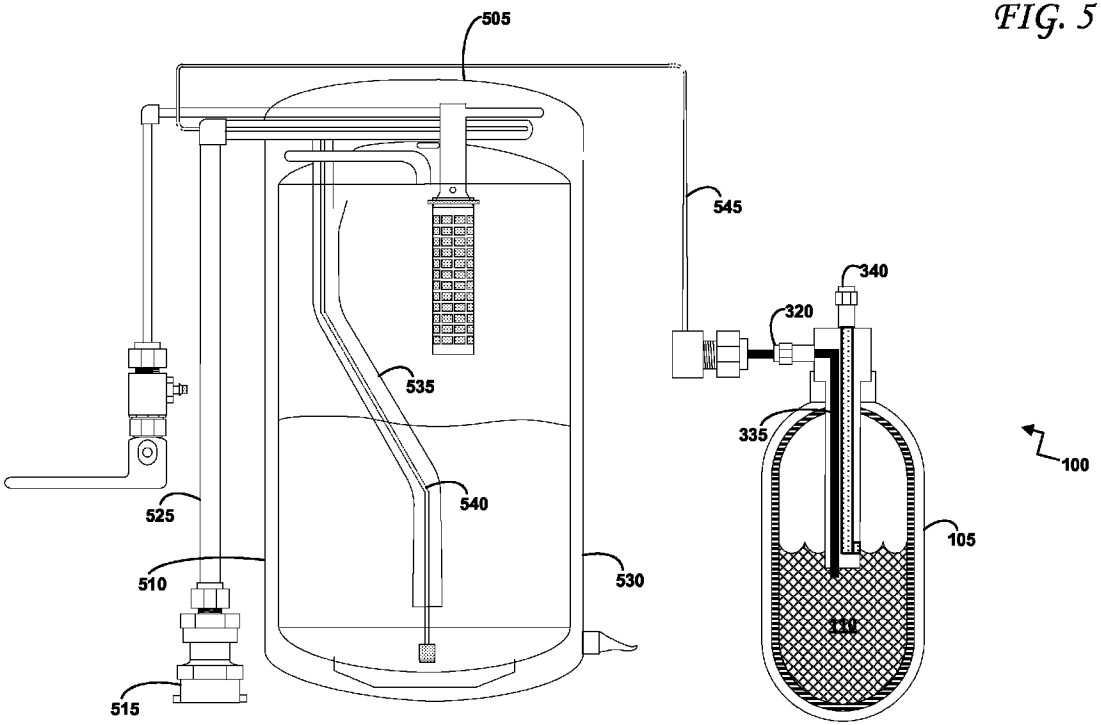
FIG. 5 provides an illustration of an oxygen transfill system in accordance with an alternative embodiment of the present invention.

FIG. 5 provides an illustration of an oxygen transfill system 100 in accordance with yet another alternative embodiment of the present invention. In this alternative embodiment, oxygen transfill system 100 is enabled to be filled from a portable liquid oxygen container 505. Portable liquid oxygen container 505 of an exemplary embodiment can be transported by the user to permit filling of portable compressed oxygen devices outside of the home. For example, and not limitation, the user can place the portable liquid oxygen container 505 in the trunk of his/her vehicle or in a suitcase. In this manner, the user is enabled to make liquid oxygen for the liquid oxygen evaporation device 105 highly accessible.

In an exemplary embodiment, portable liquid oxygen container 505 includes an inner liquid oxygen container 510 that contains a quantity of liquid oxygen. Inner liquid oxygen container 510 of the liquid oxygen device 505 can be filled by a stationary canister via fill a port 515. Fill port 515 can allow removable connection to a stationary liquid oxygen dewar. In exemplary embodiment, fill port 515 is adapted for mating engagement with discharge port of stationary LOX storage canister. Mating engagement may be via a direct connection or via a transfer conduit (not shown). Fill port 515 connects to inner liquid oxygen container 510 via a fill line 525 to communicate the liquid oxygen to the inner liquid oxygen container 510 via fill tube 535. Portable liquid oxygen container 505 can also include an outer container 530. The space between the outer container 530 and the inner liquid oxygen container 510 can be evacuated to at least a partial vacuum in order to minimize heat transfer to the LOX inside the inner liquid oxygen container 510.

In an exemplary embodiment, portable liquid oxygen container 505 can include a liquid use tube 540. Liquid use tube 540 can be contained in fill tube 535 and can extend down into the lower portion of inner liquid oxygen container 510. Liquid oxygen can be permitted to pass through the liquid use tube 535 to the liquid use connector 545. Of course, the use tube and the fill tube need not be contained within one another, but can be separate tubes.

In an exemplary embodiment, liquid oxygen evaporation device 105 can be connected to liquid use connector 545 of portable liquid oxygen container 505 such that liquid oxygen is delivered to oxygen transfill system 100. As shown in FIG. 5, liquid oxygen evaporation device 105 includes an input port 320 that connects to liquid use connector 545 of portable liquid oxygen container 505. Liquid oxygen evaporation device 105 includes a liquid fill tube 335, through which liquid oxygen is delivered from input port 320 into evaporation chamber 110. As shown in FIG. 3, evaporation chamber 110 can contain both liquid oxygen and gaseous oxygen in various proportions. For example, and without limitation, evaporation chamber 110 can be filled to a level equivalent to the liquid fill tube 335.

In accordance with an exemplary embodiment of the method of oxygen transfill 200 of the present invention, the user can be enabled to use the oxygen transfill system 100 depicted in FIG. 5 to safely, conveniently, and rapidly fill a portable compressed oxygen device 310 (not shown). In the exemplary embodiment depicted in FIG. 5, the method of oxygen transfill 200 can rely upon the portable liquid oxygen container 505 as the source for liquid oxygen. This particular embodiment provides the user with increased flexibility. As portable liquid oxygen container 505 shown in FIG. 5 can be transported outside of the home, the user is enabled to fill portable compressed oxygen devices in almost any location. For example, and without limitation, the user can place the portable liquid oxygen container 505 in the trunk of a car. Therefore, whenever it is necessary to refill a portable compressed oxygen device, the user can perform an exemplary embodiment of the method of oxygen transfill 200 of the present invention by accessing portable liquid oxygen container 505 in the trunk of the car.

Additionally, in another non-limiting example, the user could transport the portable liquid oxygen container 505 to a hotel room or temporary residence, such as a RV, campground, or friend or relative's home. Therefore, whenever it is necessary to refill a portable compressed oxygen device, the user can perform an exemplary embodiment of the method of oxygen transfill 200 of the present invention by accessing portable liquid oxygen container 505 in the hotel room or temporary residence of the user.

The first step of an exemplary embodiment of the method of oxygen transfill 200, using the exemplary embodiment of oxygen transfill system 100 shown in FIG. 5, involves filling evaporation chamber 110 with liquid oxygen from portable liquid oxygen container 505 by connecting liquid use connector 545 to input port 320 of liquid oxygen evaporation device 105. Once connected, liquid from liquid use connector 545 can flow into evaporation chamber 110. Next, the liquid oxygen in the evaporation chamber can be permitted to boil. The process of boiling can occur through the natural warming of liquid oxygen evaporation device 105 to the ambient environment or can be induced with a heating apparatus in liquid oxygen evaporation device 105. Once the liquid in the evaporation chamber begins to boil, gaseous oxygen begins to build in evaporation chamber 110.

In accordance with an exemplary embodiment of the method of oxygen transfill 200, evaporation chamber 110 maintains the gaseous oxygen as it builds to a predetermined pressure level. Once this predetermined pressure level has been achieved, gaseous oxygen can be output from liquid oxygen evaporation device 105 to a portable compressed oxygen device connected to output port 340. The entire method can be quickly and safely performed by the user in a remote location proximate portable liquid oxygen container 505.

It can be appreciated that the present invention, as described above and shown in the figures, provides a gaseous oxygen transfill system that enables quick and convenient transfill. It is also capable of filling a portable gaseous oxygen tank without a compressor. In addition, the present transfill system enables a user to safely and conveniently perform high pressure oxygen transfill from a liquid source in the user's home.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An oxygen transfill system comprising:

a liquid oxygen evaporation device, the liquid oxygen evaporation device comprising:

an evaporation chamber adapted to receive a quantity of liquid oxygen and to evaporate a portion of the quantity of liquid oxygen into a quantity of gaseous oxygen, the evaporation chamber configured to store the liquid oxygen and the evaporated portion of liquid oxygen at a predetermined storage pressure, wherein the evaporation chamber includes an insulation layer configured to reduce the rate of heat transfer between the evaporation chamber and ambient environment; and a pressure regulator adapted to maintain the quantity of gaseous oxygen at the predetermined storage pressure in the evaporation chamber;

wherein the liquid oxygen evaporation device is configured to be removably coupled with a portable compressed oxygen device configured to receive at least a portion of the quantity of gaseous oxygen from the liquid oxygen evaporation device and store received gaseous oxygen, wherein the predetermined storage pressure exceeds 500 psig, and wherein the oxygen transfill system is configured to be ambulated by a user.

2. The system of claim 1, wherein the oxygen transfill system is configured such that ambulation by the user includes one or more of carrying the oxygen transfill system, transporting the oxygen transfill system via a hand-cart associated with the user, or transporting the oxygen transfill system via a car associated with the user.

3. The system of claim 1, wherein the liquid oxygen evaporation device is configured such that a capacity of the portable compressed oxygen device is larger than a capacity of the evaporation chamber.

4. The system of claim 1, further comprising the portable compressed oxygen device, wherein the portable compressed oxygen device is configured such that one or more of a diameter, a height, a capacity, or a weight of the portable compressed oxygen device conforms to an industry standard, and wherein the industry standard includes one or more of M-2, M-4, M-6, ML-6, M-7, M-9, M-15, or M-24.

5. The system of claim 4, wherein the portable compressed oxygen device weighs less than about 8 lbs.

6. The system of claim 1, wherein evaporation chamber and the pressure regulator are configured such that the quantity of gaseous oxygen is stored in the evaporation chamber for greater than four hours.

7. The system of claim 1, wherein the liquid oxygen evaporation device is located in a home of the user.

8. The system of claim 1, wherein the liquid oxygen evaporation device further comprises a heating device configured to heat the liquid oxygen in the evaporation chamber.

9. The system of claim 1, wherein the predetermined storage pressure is between about 1,500 psig and about 3,000 psig.

10. A method for oxygen transfill with an oxygen transfill system, the oxygen transfill system comprising a liquid oxygen evaporation device, the liquid oxygen evaporation device comprising an evaporation chamber and a pressure regulator, wherein the evaporation chamber includes an insulation layer, the method comprising:

receiving, with the evaporation chamber, a quantity of liquid oxygen;

evaporating, with the evaporation chamber, a portion of the quantity of liquid oxygen into a quantity of gaseous oxygen;

storing, with the evaporation chamber, the liquid oxygen and the evaporated portion of liquid oxygen at a predetermined storage pressure;

maintaining, with the pressure regulator, the quantity of gaseous oxygen at the predetermined storage pressure in the evaporation chamber;

reducing, with the insulation layer, the rate of heat transfer between the evaporation chamber and ambient environment; and removably coupling the liquid oxygen evaporation device with a portable compressed oxygen device configured to receive at least a portion of the quantity of gaseous oxygen from the liquid oxygen evaporation device and store received gaseous oxygen, the coupling performed by the liquid oxygen evaporation device, wherein the oxygen transfill system is configured to be ambulated by a user, and wherein the predetermined storage pressure exceeds 500 psig.

11. The method of claim 10, wherein ambulation by the user includes one or more of carrying the oxygen transfill system, transporting the oxygen transfill system via a handcart associated with the user, or transporting the oxygen transfill system via a car associated with the user.

12. The method of claim 10, wherein the liquid oxygen evaporation device is configured such that a capacity of the portable compressed oxygen device is larger than a capacity of the evaporation chamber.

13. The method of claim 10, wherein the portable compressed oxygen device is configured such that one or more of a diameter, a height, a capacity, or a weight of the portable compressed oxygen device conforms to an industry standard, and wherein the industry standard includes one or more of M-2, M-4, M-6, ML-6, M-7, M-9, M-15, or M-24.

14. The method of claim 10, wherein the portable compressed oxygen device weighs less than about 8 lbs.

15. The method of claim 10, further comprising storing the quantity of gaseous oxygen in the evaporation chamber for greater than four hours.

16. The method of claim 10, further comprising locating the liquid oxygen evaporation device in a home of the user.

17. The method of claim 10, further comprising heating the liquid oxygen in the evaporation chamber with a heating device of the liquid oxygen evaporation device.

18. The method of claim 10, wherein the predetermined storage pressure is between about 1,500 psig and about 3,000 psig.

* * * * *